US005692679A

United States Patent [19]

Marran et al.

[11] Patent Number: 5,692,679

[45] Date of Patent: Dec. 2, 1997

[54] AIR PURGING SYSTEM FOR A FUEL PUMPING SYSTEM SUPPLYING FUEL TO AN OIL BURNER

[75] Inventors: John D. Marran, Califon, N.J.; Jack F. Marran, Bayport, N.Y.

[73] Assignee: Energy Kinetics, Inc., Lebanon, N.J.

[21] Appl. No.: 480,112

[22] Filed: Jun. 7, 1995

[51] Int. Cl.[6] ..... B05B 9/00

[52] U.S. Cl. ..... 239/127; 239/70

[58] Field of Search ..... 239/70, 71, 112, 239/124, 125, 127, 569, 570, 571, 572, 583, 584; 137/117, 108

[56] References Cited

U.S. PATENT DOCUMENTS

| | | | |
|---|---|---|---|
| 3,402,733 | 9/1968 | McAlvay | 137/467.5 |
| 3,446,231 | 5/1969 | Magnusson | 137/108 |
| 4,021,155 | 5/1977 | Erikson et al. | 417/302 |
| 4,490,105 | 12/1984 | Hunsberger et al. | 239/127 X |
| 4,708,156 | 11/1987 | Knudsen | 137/117 |
| 5,145,328 | 9/1992 | Harwath | 417/299 |
| 5,234,163 | 8/1993 | Fritz | 239/70 |
| 5,265,652 | 11/1993 | Brunella | 141/59 |
| 5,368,068 | 11/1994 | Hunsberger et al. | 239/571 X |

OTHER PUBLICATIONS

Suntec, Product Brochure entitled "Performance Proven Fuel Units and Valves," catalog No. 3000–0989. (no date provided).

Product literature for TIGERLOOP® Oil Deaerator. (no date provided).

*Primary Examiner*—Andres Kashnikow
*Assistant Examiner*—Lisa Ann Douglas
*Attorney, Agent, or Firm*—Dickstein Shapiro Morin & Oshinsky LLP

[57] ABSTRACT

An air purging system for an oil burner system having at least one fuel burner nozzle is disclosed. The system has a pump having an inlet communicating with the fuel source and an outlet. A control valve is provided for regulating the pressure of the fuel supplied from the pump to the at least one fuel burner nozzle. A control valve has an inlet passage for receiving high pressure fuel from the outlet of the pump, an outlet passage for delivering fuel to the at least one fuel burner nozzles, and a return passage for permitting high pressure fuel not supplied to the one or more fuel burner nozzles to return to the fuel source. The system includes a passageway connecting the pump outlet and the control valve inlet. An air purging assembly is connected on one end to the pump outlet with the other end in communication with the fuel source. The air purging assembly includes a check valve, a filter, and an orifice, wherein the orifice is size such that the relatively small amount of fuel flows therethrough thereby purging entrapped air from the system by returning air and fuel to the fuel source such that the entrapped air is vented to the atmosphere.

9 Claims, 2 Drawing Sheets

AIR PURGING SYSTEM FOR A FUEL PUMPING SYSTEM SUPPLYING FUEL TO AN OIL BURNER

FIELD OF THE INVENTION

The present invention relates generally to an air purging system for an oil burner having provision for automatically and continuously purging air from the system. More particularly, the present invention is especially adapted to automatically purge air in a two-pipe system.

BACKGROUND OF THE INVENTION

A known pumping system for an oil burner system is the so-called two-pipe system, meaning that one pipe (an intake pipe) delivers fuel from a fuel supply tank to the pump of the pumping system while the second pipe (a return pipe) returns fuel to the fuel supply tank. The intake pipe usually has a filter located between the fuel supply tank and fuel pump to prevent damage to the pump. A fuel atomizing device is located downstream of the fuel pump.

A problem with the two-pipe system is that the flow from the fuel supply tank is the capacity of the fuel pump—usually between 15–25 gallons per hour (GPH). In most residential applications, however, combustion requirements (fuel delivered by the atomizing device to the combustion process) do not exceed 1.5 GPH. The amount of fuel pumped is therefore 10–16 times more than the combustion rate, which has the following negative effects.

1. The filter requires changing more frequently than necessary causing costly service and/or unreliable operation.

2. If the fuel supply tank is contaminated (and many are) with debris and the like, for a period of time during and after the delivery of fuel, the fuel supply tank is stirred and for a period of time the fuel being pumped is heavily contaminated. Because of the excessive fuel flow in the two-pipe system, the filter may become blocked in just several hours following the delivery of fuel.

3. An additional problem with the two-pipe fuel system, is that fuel is returned to the tank at the pumping rate less combustion rate, which causes turbulence and stirring of the fuel supply (for example, at 25 GPH pumping rate and 1.5 GPH combustion rate, excess fuel would be returned to the fuel supply tank at the rate of 23.5 GPH).

4. A failure of the return pipe, which is usually under pressure, may cause a leak and has the potential for a severe environmental problem because it is difficult to detect. This problem is directly proportional to the flow rate flowing through the return pipe.

An alternative to the two-pipe system is the so-called one-pipe system, meaning that one pipe (an intake pipe) delivers fuel from the fuel supply tank to the fuel pump. A return line or bypass connects the pump outlet to the pump inlet such that excess fuel pumped is recirculated. In the one-pipe system, the fuel pump is more likely to lose its prime if a suction line leak occurs in the fuel supply line because the air which enters the suction line is recirculated through the system. One-pipe systems also frequently lose their prime from the fuel gassing off when sucked up from the fuel supply tank. In either case, this problem causes a service call to be made to reprime the system and sometimes requires several attempts at repriming the pump.

One proposed solution to reducing the fuel flow supplied to the pump from the storage tank is disclosed in U.S. Pat. No. 3,402,733 to McAlvay. The air purging system disclosed is primarily directed to purging air from the system upon start-up of the pump in the two-pipe system. Once steady state operation is achieved, the fuel flow returning to the storage tank is still the pumping rate less the combustion rate. Air purging in the one-pipe system is only manual.

A different proposed solution to deaerating the fuel is a commercially available product called a TIGERLOOP® which is installed on one-pipe system. This product has an inlet directly communicating with the fuel supply tank, an outlet communicating with the pump inlet, and a recirculating line communicating with the pump outlet. Excess fuel is returned to the pump inlet and air is vented from the device into the space where the device is located. The disadvantage of this product is that a potential malfunction may leak oil into the space where the device is located which is indoors and adjacent to the burner.

SUMMARY OF THE INVENTION

It is, therefore, an object of the present invention to provide an air purging system which eliminates to a great degree the problems of the known one-and two-pipe systems.

It is a further object of the present invention to provide an air purging system which can be easily connected to existing installations.

It is another object of the present invention to provide an air purging system which reduces the inlet flow from the fuel tank to the pump.

It is yet a further object of the present invention to reduce potential for suction line leaks.

It is yet another object of the present invention to provide an air purging assembly which is Simple in construction, effective in operation and economical to manufacture.

These and other objects of the present invention will become more apparent during the course of the following detailed description and appended claims.

To achieve the above-named objects, an air purging system for an oil burner fuel supply system has been developed. In the system, a conventional pump has an inlet communicating with a fuel source and an outlet. A control valve for regulating the pressure of the fuel supply pump to one or more fuel burner nozzles is provided. The control valve has an inlet passage for receiving high pressure fuel from the outlet of the pump, an outlet passage for communicating the regulated high pressure fuel to one or more fuel burner nozzles, and a return passage for permitting high pressure fuel not supplied to the one or more fuel burner nozzles to return to the pump inlet. A passageway connects the pump outlet and the control valve inlet. The air purging assembly is connected at one end to the manual bleed location between the pump outlet and the pressure control valve and at the other end to the fuel tank. The air purging assembly includes a check valve, a filter and an orifice. The orifice is sized such that a relatively small amount of fuel flows through it, thereby purging any air from the system by returning air and fuel to the fuel tank. Air returned to the fuel tank is vented to the atmosphere through the tank vent which is usually outside.

DETAILED DESCRIPTION OF PREFERRED EMBODIMENTS

Figure 1:
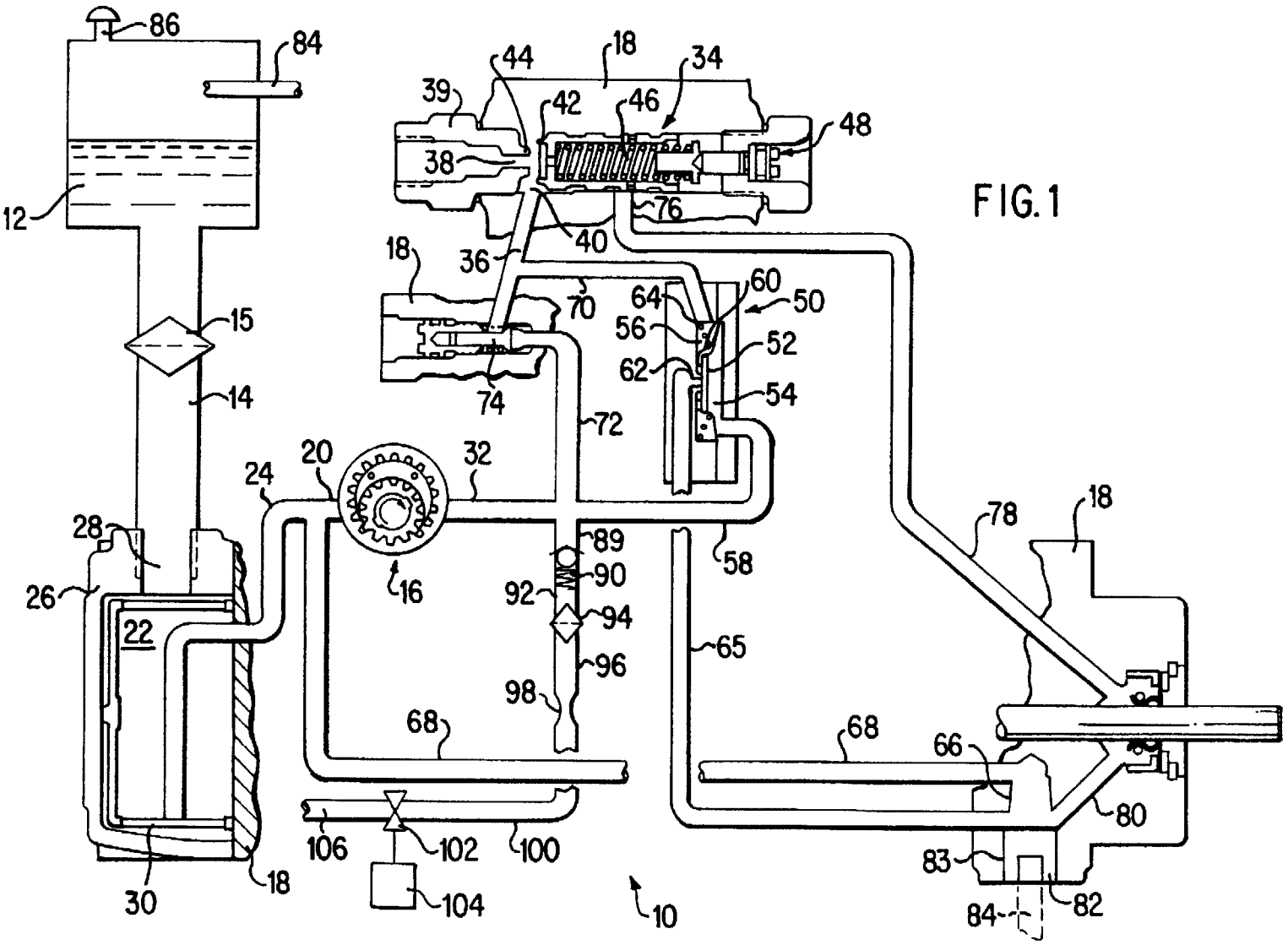
FIG. 1 is a diagram, partially in section, of a two-pipe system including an air purging assembly according to the present invention.

Refer first to FIG. 1, wherein a diagram according to the present invention is shown and wherein like reference numerals indicate like parts throughout the several views. FIG. 1 shows a system 10 of the type used to supply fuel oil to one or more oil burners (not shown) such as might be incorporated in a furnace or boiler. Fuel oil from a source, such as a tank 12, is drawn therefrom through an intake line 14 by a pump 16 to one or more nozzles on the oil burner. Tank 12 might be a considerable distance from pump 16 and thus intake line 14 may be relatively long. Tank 12 usually, but not necessarily, would be located outside and may be located below pump 16 such that the pump 16 must create a suction in line 14 to draw fuel oil from tank 12. A filter 15 is typically located in line 14.

Pump 16 includes a body or housing 18 and is of the crescent gear type although other types of positive displacement type pumps may be suitable. An example of a pump usable with the present invention is Model No. AZVA-7116 made by Suntec Industries, Inc. of Rockford, Ill. A complete description of a pump suitable for use in the present invention is described, for example, in U.S. Pat. No. 5,145,328, the disclosure of which is incorporated herein by reference.

An inlet 20 of pump 16 communicates with a reservoir 22 by means of a passage 24 in housing 18. Reservoir 22 is defined by an end cover 26 bolted to one end of housing 18 and having an intake port 28 to which intake line 14 is connected. A suitable strainer or filter 30 is located within reservoir 22 between intake port 28 and pump inlet 20 and serves to filter the fuel as it is drawn from tank 12 to pump 16. Pump 16 has an outlet passage 32 which delivers fuel to a main regulating valve assembly 34 which regulates the pressure of the fuel to be at a substantially constant pressure when delivered to the nozzle of the oil burner.

Regulating valve assembly 34 is located in housing 18 and serves to control the flow of fuel from a fuel supply passage 36 to a nozzle passage 38 which leads to the fuel burner. Regulating valve assembly 34 is slidably mounted within a pressure chamber 40 which communicates with fuel supply passage 36. Regulating valve assembly 34 has a disc 42 which is engagable with a valve seat 44 defined in housing 16 to close nozzle passage 38.

In operation, pressurized fuel entering pressure chamber 40 from passage 36 moves a portion of valve assembly 34 to the right against the bias of a coil compression spring 46 and reacting against a normally stationary but adjustable spring seat 48. When the pressure in chamber 40 is sufficient to overcome the bias of spring 46, disc 42 moves to the right to permit fuel to flow into nozzle passage 38.

A diaphragm valve 50 causes pump 16 to reach a high start-up revolutions per minute (R.P.M.) before valve assembly 34 opens and causes it to close after pump 16 falls below a high R.P.M. upon shut down. Diaphragm valve 50 includes a resilient diaphragm 52 therein. The chamber is divided into a first compartment 54 and a second compartment 56 by diaphragm 52. First compartment 54 communicates with pump outlet 32 by a passage 58 in housing 18. A valve member 60 is located in compartment 56, and is carried by diaphragm 52 and is urged away from a control port 62 by a spring 64. Control port 62 is connected to a passage 65 which, in turn, leads to a return port 66 in housing 18, and then with pump inlet 20 by way of return line 68.

An additional passage 70 establishes communication between supply passage 36 and compartment 56 of diaphragm valve 50. Pressurized fluid from outlet 32 of pump 16 flows to supply passage 36 by way of a passage 70 and an adjustable cone valve 74.

In the illustrated arrangement, spring 64 normally holds valve member 60 of diaphragm valve 50 in an open position with respect to control port 62. When pump 16 is started, fuel from outlet 32 is supplied to compartment 54 of valve 50 through passage 58, is delivered to supply passage 70 via passage 72 and cone valve 74, and is supplied to compartment 56 of valve 50 by way of passage 70. During start-up, when pump 16 is at relatively low speed, the flow past cone valve 74 is relatively low and thus the differential between the pressure in compartment 54 and the pressure in compartment 56 is not sufficiently great to overcome spring 64 and close valve member 60 with respect to control port 62. As a result, fuel delivered to compartment 56 from passage 70 flows through the control port 62 and returns to inlet 20 of pump 16 by way of passage 64, the return port 66 and return line 68.

As long as the speed of pump 16 is relatively low, valve member 60 of diaphragm valve 50 remains open and prevents a build up of pressure in chamber 40 of regulating valve 34 so that it stays closed. As the pump speed increases, however, the increased flow past cone valve 74 causes the pressure differential between compartments 54 and 56 to increase sufficiently that the pressure in compartment 54 overcomes the force of spring 64 and closes valve member 60 against control port 62. With control port 62 closed, the pressure in chamber 40 rises rapidly and such pressure opens valve assembly 34 against the force of spring 46 so as to allow fuel to flow from the supply passage 36 to nozzle passage 38. In this way, valve assembly 34 opens rapidly in response to pump speed and flow.

When pump 16 shuts down, valve member 60 of diaphragm valve 50 opens after pump 16 drops below full speed. Opening of valve member 60 quickly reduces the pressure in chamber 40 to enable valve assembly 34 to rapidly close. Reference is made to Swedberg, U.S. Pat. No. 3,566,901, for a more complete disclosure of the operation of the diaphragm valve.

Only a portion of the fuel from fuel supply passage 36 flows through nozzle passage 38 during operation of pump 16. The remaining fuel bypasses nozzle passage 38 and exits pressure chamber 40 through a by-pass port 76. In normal operation, pressure in chamber 40 is sufficiently high to move valve assembly 34 to the right to such an extent that valve 34 uncovers by-pass port 76 to allow fuel to flow continuously to that port.

Fuel discharged from by-pass port 76 is returned to pump inlet 20 by a return line 78 and a return line 80, both formed in housing 18, which are connected to return port 66 and is ultimately returned to pump inlet 20 by return line 68. Alternatively, by-pass port 76 could be connected directly to reservoir 22 by a passage (not shown) in housing 18. In this manner, excess fuel oil which does not flow through nozzle passage 38 is returned directly to reservoir 22 via by-pass 76 and the passage (not shown) for recirculation through pump 16. In this instance, the passage (not shown) would communicate with reservoir 22 outside of strainer 30 and thus the excess fuel oil would be filtered before being recirculated. During normal operation of pump 16 after closing of valve member 60 of diaphragm valve 50, excess oil from by-pass port 76 is returned directly to reservoir 22 for recirculation through pump 16. Because excess fuel is not returned to tank 12 during the steady state operation, the velocity of flow in the long intake line 14 to pump 16 is kept relatively low to reduce line losses resulting from friction. In fact, air entrapped in the system can only be purged manually or upon start-up. Entrapped air is continuously recirculated back to the pump inlet until such time that the pump loses its prime and the system is shut down.

The system shown in FIG. 1 can be modified into a two-pipe system by removing pipe plug 82, and connecting this port to tank 12 by a return line 84 and installing a pipe plug (not shown) in return port 66. In this manner, air which might be in the system is purged therefrom by flowing through a slot in cone valve 74 and then through diaphragm valve 50 and return line 84 to tank 12, the latter being vented to atmosphere as indicated schematically at 86. Thus, the system is automatically purged of air when pump 16 starts by the pressurized fuel. Once diaphragm valve 50 closes, however, air is not continuously purged from the system. The two-pipe system, however, suffers the problems noted in the background of the invention, among others.

The present invention uses the arrangement shown in FIG. 1 in which pipe plug 82 is installed in port 83 and return port 66 is open. The present invention is suitable to add to existing installations and can be installed on new installations. Because most existing installations are two-pipe systems, there will usually be a return line 84 already installed. If there is not an existing return line 84, then a return line 84 would need to be installed as described below.

Figure 2:
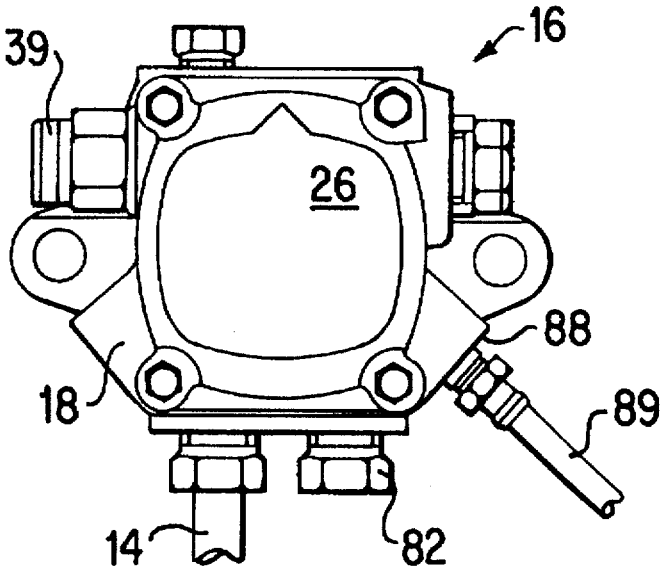
FIG. 2 is plan view of the pump schematically illustrated in FIG. 1.

Housing 18 includes a bleeder port 88 (FIG. 2) in communication with pump outlet 32. A line 89 is connected to port 88 and to a check valve 90. Check valve 90 is set at a low opening pressure (significantly less than bypass pressure) to provide minimum restriction to flow. Check valve 90 serves to prevent air from backflowing or entering the system when pump 16 is not running.

A line 92 connects check valve 90 to a filter 94 which is sized to prevent orifice 98 from becoming clogged. Orifice 98 is sized to flow approximately 2.5 GPH of fuel oil with an inlet pressure of 100–150 psi which is supplied by pump 16. In practice, orifice 98 should be sized for a particular application depending on pump size, pump flow rating, pressure and atomizing flow rate of the fuel burner nozzle. Line 96 connects filter 94 to an orifice 98. Line 100 connects orifice 98 to an optional solenoid valve 102 which may optionally be operated by a timer 104. The outlet of solenoid valve 102 is connected to a small flexible tube 106 to return fuel oil which flows through orifice 98 to tank 12. Tube 106 may alternatively be connected to reservoir 22.

Figure 3:
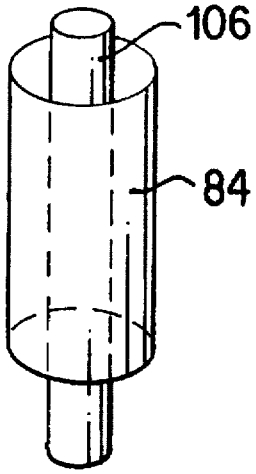
FIG. 3 is an enlarged view showing a flexible return tube concentrically mounted within the return pipe.

Refer now to FIG. 3 where flexible tube 106 is shown inserted into an existing return line 84. This optional tube within a tube arrangement provides additional protection against a leak that might develop in line 84.

In operation, check valve 90 opens almost immediately after pump 16 starts running. Entrapped air in the system is returned by fuel pressure through check valve 90, line 92, filter 94, line 96, orifice 98, line 100, optional solenoid 102 and tube 106 to tank 12 which is preferably vented to atmosphere so that air fuel vapor can be safely dispersed outdoors. Solenoid valve 102 could be kept open whenever pump 16 is running or can be opened for a controlled period by optional timer 104. In this manner, entrapped air in the system is either continuously or semi-continuously purged from the system. Assuming a flow through orifice 98 of 2.5 GPH, the flow through intake line 14 is only 2.5 GPH plus the fuel required by the nozzle on the fuel burner.

The present invention brings to the art a new and improved air purging system in which air in the system can be continuously and automatically purged from the system with minimum turbulence in the storage tank. During steady state operation, most of the excess fuel flow is directed back to the pump inlet, and not to the storage tank, thereby reducing the velocity of flow in the intake line and the intake filter and reducing turbulence in the storage tank.

While a presently preferred embodiment of the invention has been shown and described, it would be appreciated by those skilled in the art that changes may be made to this embodiment without departing from the principles and spirit of the invention, the scope of which is defined in the claims.

What is claimed is:

1. An air purging system for an oil burner having at least one fuel burner nozzle, said system comprising:

a pump having an inlet communicating with a fuel source and an outlet;

a control valve for regulating the pressure of the fuel supplied from the pump to the at least one fuel burner nozzle, said control valve having an inlet passage for receiving high pressure fuel from said outlet of said pump, an outlet passage for delivering fuel to the at least one fuel burner nozzle, and a return passage for permitting high pressure fuel not supplied to the at least one furl burner nozzle to return directly to said pump inlet;

a passageway connecting said pump outlet and said control valve inlet; and an air purging assembly connected on one end to said pump outlet with the other end in communication with the fuel source, said assembly including a check valve, a filter, and an orifice, said filter being positioned between said check valve and said orifice, wherein said orifice is sized such that a relatively small amount of fuel flows there through thereby purging entrapped air from the system by returning air and fuel to the fuel source such that the entrapped air is vented to atmosphere.

2. The system of claim 1, further comprising:

a solenoid valve disposed between said orifice and the fuel source; and a timer for selectively opening said solenoid valve.

3. The system of claim 1, wherein said air purging assembly includes a passageway connected to said pump outlet at one end and in communication with the fuel source at the other end, said filter disposed in said passageway, said check valve disposed in said passageway between said filter and said pump, said orifice disposed between said filter and the fuel source.

4. The system of claim 1, wherein said pump is positioned above the fuel source.

5. The system of claim 1, wherein said return passage is connected to the fuel source and a portion of said air purging assembly is mounted concentrically in said passageway.

6. The system of claim 1, further comprising a bypass circuit operable during pump startup and selectively movable between open and closed positions, said bypass circuit blocking fuel from entering said control valve when in said closed position and returning the fuel to one of said pump inlet and said control valve inlet, and said bypass circuit permitting fuel to enter said control valve when in said open position.

7. The system of claim 1, further comprising:

a filter disposed between the fuel source and said pump inlet.

8. The system of claim 1, wherein said check valve opening pressure is lower than the pressure at which fuel is delivered from said pump outlet.

9. A method of removing air from an oil burner system comprising the steps of:

a) supplying fuel from a fuel tank to a pump;

b) pumping the fuel from the pump to an atomizing device;

c) returning excess fuel pumped to the atomizing device back to an inlet of the pump;

d) drawing off a portion of the fuel pumped during said pumping step to the fuel tank, said drawing off step further including:

(1) passing said portion of the fuel through a check valve;

(2) filtering said portion of the fuel passed through said check valve; and, (3) passing said filtered portion of the fuel through an orifice, said orifice being in connection with the fuel tank; and, e) venting the fuel tank to atmosphere such that any air contained in the system is purged therefrom.

* * * * *